United States Patent [19]

Hall et al.

[11] 4,386,638

[45] Jun. 7, 1983

[54] COUPLING FOR WATERBED MATTRESS VALVES

[75] Inventors: Charles P. Hall, Muir Beach; John B. Johenning, Beverly Hills, both of Calif.

[73] Assignee: Monterey Manufacturing, Inc., Los Angeles, Calif.

[21] Appl. No.: 250,727

[22] Filed: Apr. 3, 1981

[51] Int. Cl.[3] ..... B65B 3/04

[52] U.S. Cl. ..... 141/98; 141/382; 141/384; 141/392; 137/140; 285/354; 285/354;302;332

[58] Field of Search ..... 141/285, 286, 65, 66, 141/7, 98, 313, 382-386, 279, 392; 137/140

[56] References Cited

U.S. PATENT DOCUMENTS

| | | | |
|---|---|---|---|
| 3,323,536 | 6/1967 | O'Connor et al. | 137/140 |
| 3,957,295 | 5/1976 | Gould et al. | 285/354 |
| 4,072,328 | 2/1978 | Elliott | 285/354 |
| 4,212,335 | 7/1980 | Bova | 141/382 |

*Primary Examiner*—Houston S. Bell, Jr.
*Attorney, Agent, or Firm*—Lyon & Lyon

[57] ABSTRACT

A coupling for filling and draining a waterbed comprises a tube for insertion into the male-threaded filler neck of a waterbed valve, and two female-threaded nuts rotatably mounted on the tube for connection to a garden hose and the male-threaded fill neck of the waterbed. There is a plurality of fill and drain openings through the wall of the portion of the tube inserted into the fill neck.

4 Claims, 5 Drawing Figures

COUPLING FOR WATERBED MATTRESS VALVES

BACKGROUND

This invention relates to waterbeds, and in particular, a coupling for filling and draining waterbed mattresses.

Waterbed mattresses are provided with valves for filling and draining the mattress. The valve can be provided with an exteriorly male-threaded fill neck. To fill the mattress, a conduit such as a garden hose is connected to a water source. A coupling is required for interposition between the male-threaded fitting on the outer end of the garden hose and the exteriorly male-threaded fill neck of the waterbed.

A suitable coupling is described in U.S. Pat. No. 4,212,335. That coupling includes a tube for telescopic insertion into the male-threaded fill neck and a female-threaded fitting on the outer end of the tube for coupling with the male-threaded fitting of the garden hose.

A problem with this prior art coupling is that when draining the waterbed mattress, the end of the tube inserted into the mattress can become plugged by the vinyl walls of the mattress being sucked into the open end of the tube as the water levels drops. Thus, with such a coupling, it is possible to only partially drain a waterbed mattress using a siphon.

Another problem with the prior art coupling is that the female-threaded fitting on the outer end of the tube is fixed relative to the tube. To connect the fitting onto a garden hose often requires screwing the garden hose into the fitting, which is difficult and can kink the garden hose.

In view of these problems, it is apparent that there is a need for a waterbed filling unit which is easy to use, is practical, reliable, durable, and which can be used for substantially completely draining waterbed mattresses.

SUMMARY

The present invention provides a coupling that satisfies this need. The coupling is designed for interposition between and connection with the male-threaded fitting on the outer end of a garden hose and the exteriorly male-threaded fill neck of a waterbed. The coupling comprises an elongated hollow tube having a first insertion end with an associated first end portion for telescopic insertion into the male-threaded fill neck. The coupling also has an opposed second end. There is a first female-threaded fitting on the tube adjacent the insertion end for coupling to the male-threaded fitting of the garden hose. Preferably the first female-threaded fitting is rotably mounted on the tube and is provided with a first external annular stop flange adjacent to the second end of the tube to prevent the first fitting from sliding off the tube.

There is also a second female-threaded nut-type fitting rotatably mounted on the tube. The second fitting is intermediate the first fitting and the insertion portion of the tube for coupling with the male-threaded neck. An external annular stop flange on the tube adjacent the second fitting prevents both fittings from sliding off the first end of the tube.

The first end portion of the tube, which is inserted into the fill neck, has a plurality of fill and drain openings through its wall. By placing the fill and drain openings in the wall of the tube, even if first end of the tube becomes plugged by the waterbed mattress material, it is still possible to drain water from the mattress.

DRAWINGS

These and other features, aspects and advantages of the present invention will become better understood with reference to the following description, appended claims, and accompanying drawings where:

DESCRIPTION

Figure 1:
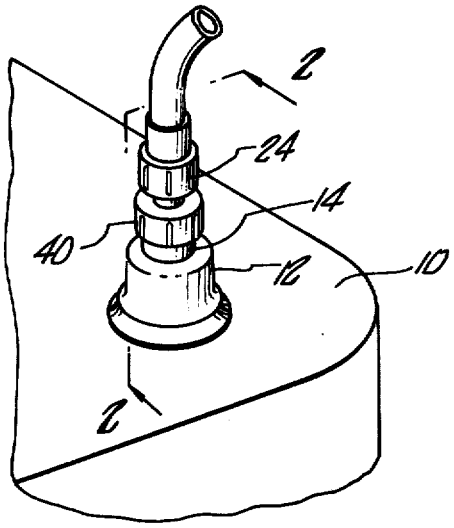
FIG. 1 is a view showing a coupling according to the present invention in use.

With reference to the drawings, a waterbed mattress 10 is provided with a valve 12 such as a Roberts valve sold under the designation 670-ADL. The valve is heat-welded to the mattress 10. The valve 12 includes an exteriorly male-threaded fill neck 14.

A coupling or waterbed filling unit 16 according to the present invention comprises an elongated, hollow tube 18 having first 20 and second 22 opposed ends. In use of the coupling 16, the first or insertion end 20 is telescopically inserted into the fill neck 14. The portion of the tube 18 that in inserted into the fill neck 14 is referred to herein as the first end portion or insertion portion 22 of the tube 14.

A first female-threaded nut-type fitting 24 is mounted on the tube 18 adjacent the second end 22. The fitting 24 preferably is rotatably mounted on the tube. For a rotatably mounted first fitting 24, there is provided a stop flange 26 to prevent the first fitting from sliding off the end of the tube 18. The first fitting is used for a coupling to a male-threaded fitting 28 of a fill conduit such as a garden hose 30 connected to a water source. A gasket 32 can be provided for the first fitting 24 to prevent water leakage.

A second female-threaded fitting 40 is also rotatably mounted on the tube 18. It is located intermediate the first fitting 24 and the insertion portion 22 of the tube 18. It is provided for coupling with the male-threaded fill neck 14 of the valve 12. A Teflon O-ring 42 is provided for the second fitting to prevent water leakage. A second annular stop flange 44 is on the tube 18 adjacent the second fitting 40 and intermediate the second fitting 40 and the insertion portion 22 of the tube 18 to prevent the second fitting 40 from sliding off the tube 18.

Figure 2:
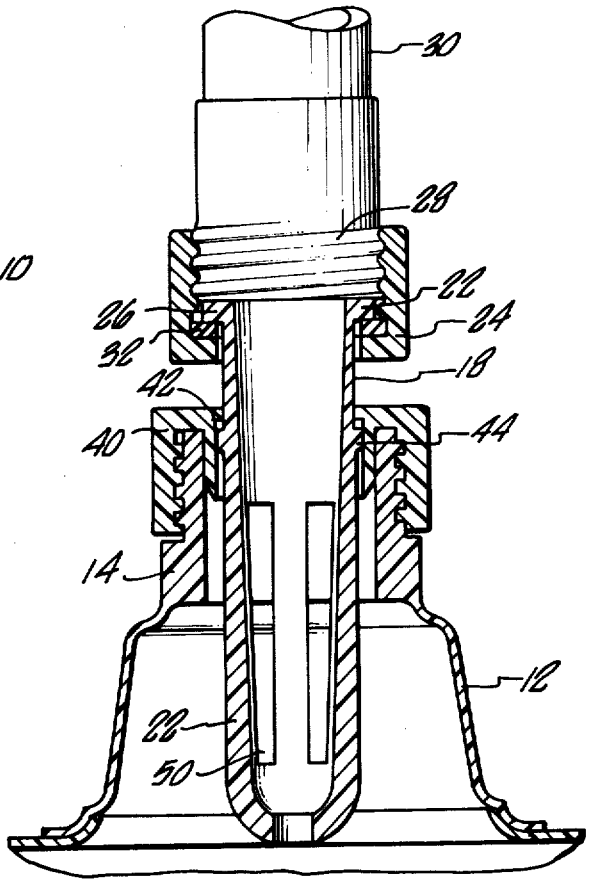
FIG. 2 is an enlarged sectional view taken substantially on line 2—2 of FIG. 1.
Figure 5:
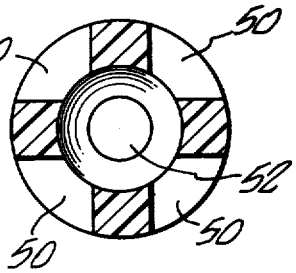
FIG. 5 is a sectional view of the coupling of FIG. 3 taken on line 5—5 in FIG. 3.
Figure 3:
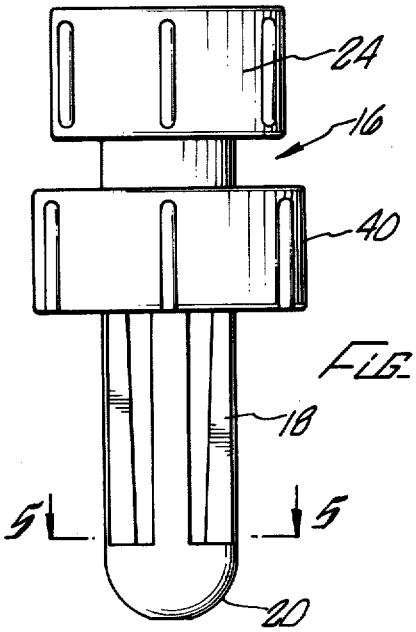
FIG. 3 is an elevation view of the coupling of FIG. 1 detached.
Figure 4:
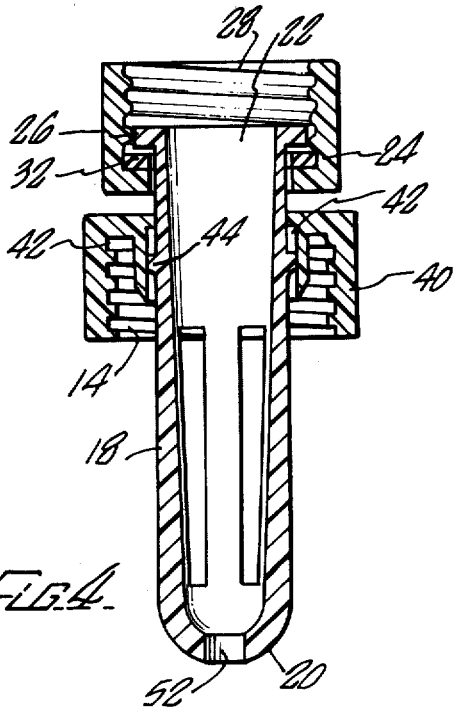
FIG. 4 is a sectional view of the coupling of FIG. 3.

As can be seen in FIG. 2, the tube 18 is sufficiently long that it extends into the mattress beyond the fill neck 14.

There is a plurality of fill and drain openings 50 through the wall of the insertion end portion of the tube. Preferably these drain openings are elongated, axially-oriented slots. By positioning these openings 50 in the wall of the tube, they cannot be plugged by the walls of the waterbed mattress 10 when draining the mattress.

As shown in the drawings, there can also be a hole 52 through the first end 20 of the tube for filling and draining the mattress, although this is not required due to the presence of the openings 50.

The coupling 16 is easily assemblied. First, the first fitting 22 with a gasket 32 mounted therein is slid over the second stop flange 44. Next, the second fitting 40 with a gasket 42 mounted therein is slid over the stop flange 44. The edge of the stop flange 44 towards the first end 20 of the tube is chamfered to allow this to easily occur, but the opposite edge has a sharp corner to prevent the fittings 22 and 40 from sliding off the tube 18.

From the foregoing description, it will readily be seen that the coupling 16 is easily produced, and is easy to use. Because both fittings 24 and 40 are rotatably mounted on the tube 18, the coupling can easily be connected to both a garden hose and the fill neck 14, in either order. Moreover, the coupling can be used for draining a waterbed mattress because the drain openings 50 do not become plugged.

While the present invention has been described in considerable detaill with reference to certain preferred versions thereof, other versions are possible. Therefore the spirit and scope of the appended claims shall not be limited to the description of the preferred versions contained herein.

What is claimed is:

1. A coupling for filling and draining a waterbed by interposition between and connection with a male-threaded fitting on the outer end of a fill conduit and the externally male-threaded fill neck of a waterbed, the coupling comprising:

(a) an elongated hollow tube having opposed first and second ends, the first end having associated therewith a first end portion for telescopic insertion into the male-threaded fill neck;

(b) a first female-threaded fitting rotatably mounted on the tube adjacent the second end for coupling to the male-threaded fitting of the fill conduit;

(c) a second female-threaded nut-type fitting rotatably mounted on the tube intermediate the first nut-type fitting and the first end portion of the tube for coupling with the male-threaded neck;

(d) an external stop flange on the tube adjacent the second fitting and intermediate the second fitting and the first end portion of the tube; and (e) at least one fill and drain opening through the wall of the first end portion of the tube.

2. A coupling for filling and draining a waterbed by interposition between and connection with a male-threaded fitting on the outer end of a fill conduit and the externally male-threaded fill neck of a waterbed, the coupling comprising:

(a) an elongated hollow tube having opposed first and second ends, the first end having associated therewith a first end portion for telescopic insertion into the male-threaded fill neck;

(b) a first external stop flange on the tube adjacent the second end of the tube;

(c) a first female-threaded nut-type fitting rotatably mounted on the tube adjacent the first stop flange and intermediate the first stop flange and the first end portion of the tube for coupling to the male-threaded fitting of the fill conduit;

(d) a second female-threaded nut-type fitting rotatably mounted on the tube intermediate the first nut-type fitting and the first end portion of the tube for coupling with the male-threaded neck;

(e) a second external annular stop flange on the tube adjacent the second nut-type fitting and intermediate the second fitting and the first portion of the tube; and (f) a plurality of fill and drain openings in the wall of the first end portion of the tube.

3. The coupling of claim 1 or 2 including a hole through the first end of the tube.

4. The coupling of claim 1 or 2 in which the fill and drain openings are axially-oriented elongated slots.

* * * * *